US005313254A

United States Patent [19]

Temple

[11] Patent Number: 5,313,254

[45] Date of Patent: May 17, 1994

[54] MOTION CONTROL SYSTEM FOR PRINTING MACHINES

[75] Inventor: Donald M. Temple, Williamson, N.Y.

[73] Assignee: Xerox Corporation, Stamford, Conn.

[21] Appl. No.: 995,500

[22] Filed: Dec. 23, 1992

[51] Int. Cl.[5] ..... G03G 15/00

[52] U.S. Cl. ..... 355/208; 355/212; 355/317; 226/28

[58] Field of Search ..... 355/208, 212, 308, 316, 355/317, 326, 326 R; 360/70, 72.2; 226/28, 45

[56] References Cited

U.S. PATENT DOCUMENTS

| | | | |
|---|---|---|---|
| 3,581,888 | 6/1971 | Kelly et al. | 209/74 |
| 3,666,883 | 5/1972 | Yano et al. | 360/70 |
| 3,790,271 | 2/1974 | Donohue | 355/14 |
| 3,851,116 | 11/1974 | Cannon | 360/72.2 |
| 3,930,725 | 1/1976 | Jones et al. | 355/14 |
| 4,045,819 | 8/1977 | Goldmark | 360/8 |
| 4,072,989 | 2/1978 | Grant | 360/80 |
| 4,263,627 | 1/1981 | Rose et al. | 360/75 |
| 4,594,618 | 6/1986 | Kozuki et al. | 360/73 |
| 4,634,404 | 1/1987 | Takano | 474/11 |
| 4,675,752 | 6/1987 | Higashi et al. | 360/10.3 |
| 5,130,745 | 7/1992 | Cloutier et al. | 355/40 |

FOREIGN PATENT DOCUMENTS

| | | | |
|---|---|---|---|
| 56-8156 | 1/1981 | Japan | 355/308 |
| 60-42771 | 3/1985 | Japan | 355/212 |
| 3-269453 | 12/1991 | Japan | 355/212 |

*Primary Examiner*—Joan H. Pendegrass
*Attorney, Agent, or Firm*—Duane C. Basch

[57] ABSTRACT

The present invention is a method and apparatus for regulating the velocity of a member constrained to move about a predefined path. The invention comprises a magnetic patch or strip, located on a surface of the member, and having a plurality of magnetic signals recorded thereon, along with a magnetic detector, positioned in proximity to said magnetic strip, for sensing the magnetic signals recorded thereon, during movement of the member, and producing an output signal in response to the magnetic signals. The invention further comprises means, operatively connected to impart a driving force to the member, and control means for regulating said driving means so that the member is driven at a velocity which is a function of the output signal.

16 Claims, 5 Drawing Sheets

MOTION CONTROL SYSTEM FOR PRINTING MACHINES

This invention relates generally to a printing machine, and more particularly to a method and apparatus for controlling the velocity of a moving photoresponsive element within the printing machine.

BACKGROUND AND SUMMARY OF THE INVENTION

A serious problem in document reproduction machines is a phenomena referred to as "banding". Banding is a defect observable in output copies resulting from variations in the speed of the moving photoreceptor during, for example, the exposure of the photoreceptor by a raster output scanning device such as a laser. The velocity variations create a misplacement of scan image lines in the slow scan or process direction. For many printer applications, the output copies must be virtually band free, requiring holding velocity variations to less than one percent, which is in the order of approximately one micron spatial variation at certain frequencies and for certain systems. In addition, newer printers incorporating light scanning sources, such as Raster Output Scanners (ROS) or image bars, create successive color exposure frames on a photoreceptor during a single pass. The leading edges of each of the successive color images must be in registration, within tolerances of approximately 125 microns. This precise tolerance requirement, in turn, necessitates a very accurate spacing between exposure frames. Hence, it is necessary to accurately control the velocity and position of the photoreceptor at all times during the electrophotographic process.

Heretofore, various methods have been employed to control the velocity of endless belts, such as a photoreceptor, of which the following disclosures which may be relevant:

U.S. Pat. No. A-3,581,888 Patentee: Kelly et al. Issued: June 1, 1971

The relevant portions of the foregoing patents may be briefly summarized as follows:

U.S. Pat. No. A-3,581,888 discloses a memory system for storing positional information of pieces of ore moving, on the surface of a belt, through a scanning zone. The system includes a belt speed sensor that is preferably a magnetic pickup positioned so as to detect the passing of slugs of magnetic material fastened at spaced intervals on the belt. The output of the belt speed sensor is a pulse series which is proportional to the speed of the belt.

U.S. Pat. No. A-3,790,271 teaches a system for controlling the processing steps of an electrostatic printing machine which employs an endless photoreceptor belt. The various processes are controlled in response to control pulses. The control pulses are generated by a magnetic pickup aligned with a drive gear operatively coupled, via a drive chain or timing belt, to the photoconductive belt. Programming control of the machine processing steps are then accomplished in response to the control pulses.

U.S. Pat. No. A-3,930,725 describes a multiple sheet feeding system for an electrostatographic printing machine. Similar to U.S. Pat. No. A-3,790,271, the system employs a magnetic pickup, aligned with a drive gear used to drive the photoconductive member, to produce control signals. The control signals are used to enable sheet conveying mechanisms to properly register sheets in timed relationship with the photoconductive member.

U.S. Pat. No. A-4,045,819 teaches an audio/video recording and playback mechanism which employs a pair of recording belts, one for the video information and the other for the audio information. The video belt is described as having properly spaced holes which are detected by an electro-optical sensor to control the speed of the belt. In another embodiment, a magnetic signal of a known frequency is located on the belt, and read out by a magnetic head, in order to obtain tight speed control.

U.S. Pat. No. A-4,072,989 discloses an audio-visual presentation device which includes a magnetic cassette tape drive and a remotely controllable slide projector. A first track of the tape contains audio signals, while a second track of the tape contains synchronization signals which are used to control the remote slide projector so that the visual presentation remains in synchronization with the audio presentation.

U.S. Pat. No. A-4,263,627 teaches an electronic tachometer for determining the speed of a servo head while traversing a series of magnetic tracks on a magnetic disk. By detecting the interaction between the head and the tracks, where the head detects a maximum signal level at the center of each track, the radial speed of the head can be determined.

U.S. Pat. No. A-4,594,618 describes, as prior art, a recording mode signal (CTL) which indicates whether the recording has been done in a standard or long-time mode. More specifically, the CTL signal is read from a tape and used to reset a counter which counts pulses from a capstan motor used to drive the tape. The recording mode is determined as a function of the maximum count achieved between successive CTL signals.

U.S. Pat. No. A-4,634,404 discloses a method of controlling the rotation speed of a driven shaft by varying the diameter of one or more variable diameter pulleys about which a V-belt is entrained. A magnetic pickup, coupled to a controller, is used to sense the position of a gear affixed in rotational association with the driven pulley. The magnetic pickup generates a speed signal in response to the projections of the gear, whereby the signals represent the rotational speed of the driven pulley.

U.S. Pat. No. A-4,675,752 teaches a method and apparatus for recording or reproducing slow motion picture images. A control pulse signal (CP) is read from magnetic tape by a control head. The CP signal is then passed to a monostable multivibrator, the output of which is used to control the voltage applied to the tape drive system to reduce resonant vibration of the tape.

In accordance with the present invention, there is provided an apparatus for regulating the velocity of a belt moving in a recirculating path. The apparatus comprises a magnetic strip, located on a surface of the belt, having a plurality of magnetic signals recorded thereon, along with a magnetic detector, positioned in proximity to said magnetic strip, for sensing the magnetic signals recorded thereon, during movement of the belt, and producing an output signal in response to the magnetic signals. The apparatus also includes control means, responsive to the output signal, for regulating said driving means so that the belt is driven at a velocity which is a function of the output signal.

In accordance with another aspect of the present invention, there is provided an apparatus for monitoring the position of a member moving along a predefined path. The apparatus comprises: a magnetic strip located on a surface of the member, said magnetic strip having at least one track suitable for recording magnetic signals thereon; a magnetic read head, operatively aligned to detect the magnetic signals recorded on the track during movement of the member; and means, responsive to a frequency at which the magnetic signals are detected on the track, for controlling the speed of the member.

Pursuant to yet another aspect of the present invention, there is provided a printing machine for producing copies of an original document, comprising a movable charge retentive member including a magnetic recording strip on a surface thereof. Also included in the apparatus are processing means for generating and developing a latent image on the charge retentive member and transferring the developed image from the charge retentive member to a copy sheet, and means for controlling the operation of said processing means in response to a signal recorded on said magnetic recording strip.

The present invention will be described in connection with preferred embodiments, however, it will be understood that there is no intent to limit the invention to the embodiments described. On the contrary, the intent is to cover all alternatives, modifications, and equivalents as may be included within the spirit and scope of the invention as defined by the appended claims.

DESCRIPTION OF THE PREFERRED EMBODIMENT

Figure 1:
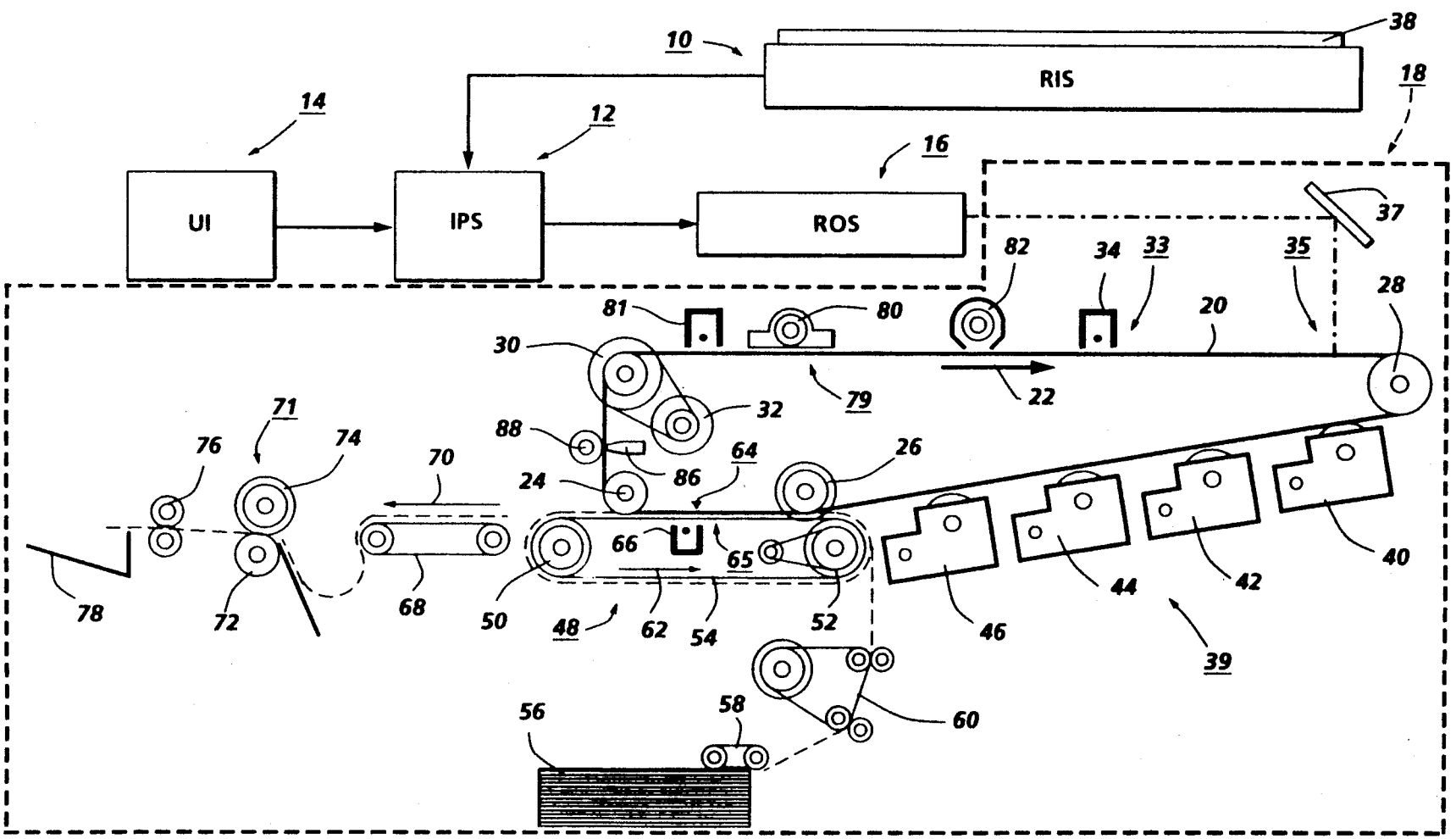
FIG. 1 is a schematic elevational view showing an electrophotographic printing machine incorporating the features of the present invention therein.

For a general understanding of the present invention, reference is made to the drawings. In the drawings, like reference numerals have been used throughout to designate identical elements. FIG. 1 shows a schematic elevational view of an electrophotographic printing machine incorporating the features of the present invention therein. It will become evident from the following discussion that the present invention is equally well suited for use in a wide variety of printing systems, and is not necessarily limited in its application to the particular system shown herein.

Turning to FIG. 1, during operation of the printing system, a multicolor original document 38 is positioned on a raster input scanner (RIS), indicated generally by the reference numeral 10. The RIS contains document illumination lamps, optics, a mechanical scanning drive, and a charge coupled device (CCD array). The RIS captures the entire image from original document 38 and converts it into a series of raster scan lines and, moreover, measures a set of primary color densities (i.e. red, green and blue densities) at each point of the original document. This information is transmitted as electrical signals to an image processing system (IPS), indicated generally by the reference numeral 12. IPS 12 converts the set of red, green and blue density signals to a set of colorimetric coordinates. The IPS contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The operator actuates the appropriate keys of UI 14 to adjust the parameters of the copy. UI 14 may be a touch screen, or any other suitable control panel, providing an operator interface with the system. The output signal from UI 14 is transmitted to IPS 12. The IPS then transmits signals corresponding to the desired image to ROS 16, which creates the output copy image. ROS 16 includes a laser with rotating polygon mirror blocks. The ROS illuminates, via mirror 37, the charged portion of a photoconductive belt 20 of a printer or marking engine, indicated generally by the reference numeral 18, at a resolution of about 400 pixels per inch, to achieve a set of subtractive primary latent images. The ROS will expose the photoconductive belt to record three latent images which correspond to the signals transmitted from IPS 12. One latent image is developed with cyan developer material. Another latent image is developed with magenta developer material and the third latent image is developed with yellow developer material. These developed images are transferred to a copy sheet in superimposed registration with one another to form a multicolored image on the copy sheet. This multicolored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22. The speed of the belt is monitored by magnetic pickup 86, in conjunction with backup roller 88, and directly controlled by motor 32 as a function of the signal received by pickup 86. Magnetic pickup 86 may be any commonly known magnetic read or read/write head, of the type typically used for reading prerecorded audio tape.

Figure 2:
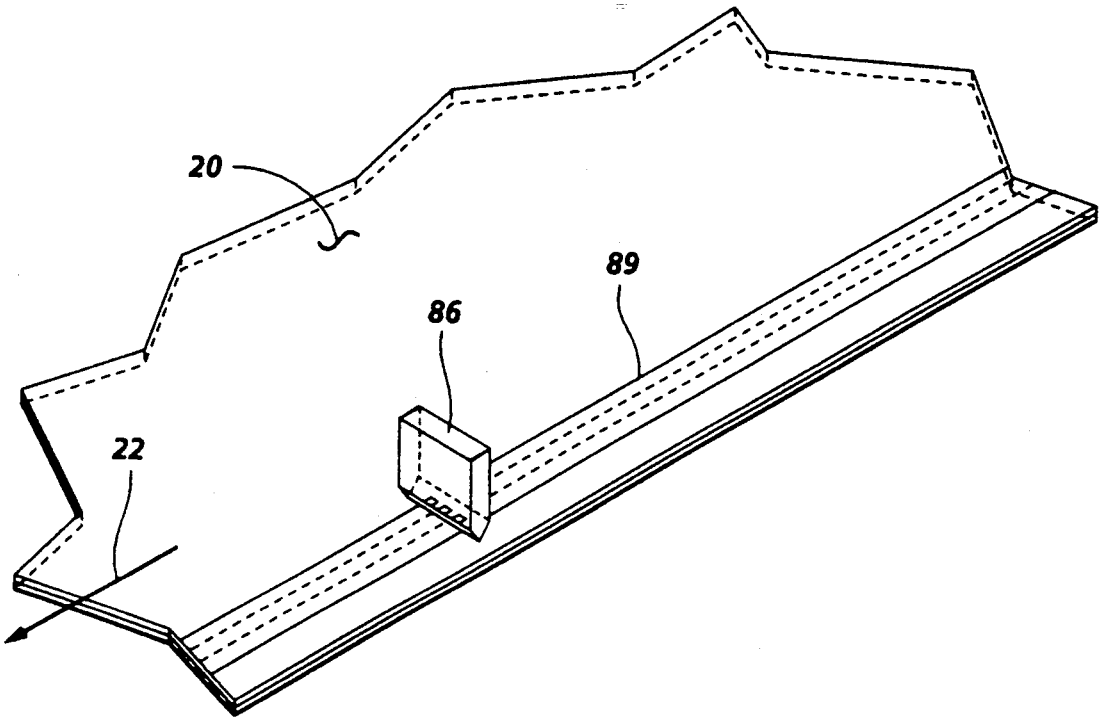
FIG. 2 is an orthographic view of the relationship between the elements of the present invention.

FIG. 2 illustrates in more detail, the rear or interior surface of belt 20, which contains a magnetic strip 88, for example a length of commonly known audio tape suitable for recording magnetic signals thereon, permanently affixed to a surface thereof. Similarly, the magnetic tape could be affixed to the outer surface of the belt, a rigid photoreceptor, or similar photoconductive member. As yet another alternative, the magnetic signals could be recorded on a transparent magnetic layer or strip which extends longitudinally along the process direction of photoconductive belt 20. For example, such a magnetic layer is described for use in a photographic film embodiment by Cloutier et al. in a patent, U.S. Pat.

No. A-5,130,745 (Issued Jul. 14, 1992), the relevant portions being hereby incorporated by reference in the instant specification. As photoconductive belt 20 is advanced in the process direction, indicated by arrow 22, the magnetic strip passes under magnetic pickup 86, where magnetic signals present on the strip may be read. Magnetic strip 88 may have one or more tracks of magnetic signals thereon and may be either a small patch of magnetic recording media extending over only a portion of the belt circumference, or longer, narrower region extending completely around the circumference of the belt. As will hereinafter be described, the magnetic signals read by magnetic head 86 are processed to determine the speed of the belt, and drive motor 32 is controlled as a function of the signals' frequency.

Continuing now with the description of the operation of the printing engine, initially, a portion of photoconductive belt 20 passes through a charging station, indicated generally by reference numeral 33. At charging station 33, a corona generating device 34 charges photoconductive belt 20 to a relatively high, substantially uniform potential.

Next, the charged photoconductive surface is rotated to an exposure station, indicated generally by the reference numeral 35. Exposure station 35 receives a modulated light beam corresponding to information derived by RIS 10 having a multicolored original document 38 positioned thereat. The modulated light beam impinges on the surface of photoconductive belt 20, and illuminates the charged portion of the photoconductive belt to form an electrostatic latent image. The photoconductive belt is exposed at least three times to record latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type commonly known as "magnetic brush development units." Typically, a magnetic brush development system employs a magnetizable developer material including magnetic carrier granules having toner particles adhering triboelectrically thereto. The developer material is continually advanced through a directional flux field to form a brush of developer material. The developer material is constantly moving so as to continually provide the brush with fresh developer material.

Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document, or that portion of the color image determined to be representative of black regions. Each of the developer units is moved into and out of an operative position. In the operative position, the magnetic brush is positioned substantially adjacent the photoconductive belt, while in the nonoperative position, the magnetic brush is spaced therefrom. More specifically, in FIG. 1, developer unit 40 is shown in the operative position with developer units 42, 44 and 46 being in nonoperative positions. During development of each electrostatic latent image, only one developer unit is in the operative position, the remaining developer units are in the nonoperative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown) extends between belts 54 and moves in unison therewith. A sheet is advanced from a stack of sheets 56 disposed on a tray. A friction retard feeder 58 advances the uppermost sheet from stack 56 onto a pre-transfer transport 60. Transport 60 advances the sheet to sheet transport 48 in synchronism with the movement of the sheet gripper. In this way, the leading edge of a sheet arrives at a preselected position, i.e. a loading zone, to be received by the open sheet gripper. The leading edge of the sheet is secured releasably by the sheet gripper. As belts 54 move in the direction of arrow 62, the sheet moves into contact with the photoconductive belt, in synchronism with the toner image developed thereon. In transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under-color or black removal is used. Each of the electrostatic latent images recorded on the photoconductive surface is developed with the appropriately colored toner and transferred, in superimposed registration with one another, to the sheet to form the multicolor copy of the colored original document.

After the last transfer operation, the sheet transport system directs the sheet to a vacuum conveyor, indicated generally by the reference numeral 68. Vacuum conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Cleaning station 79 may also employ pre-clean corotron 81, in association with brush 80, to further neutralize the electrostatic forces which attract the residual toner particles to belt 20, thereby improving the efficiency of the fibrous brush. Thereafter, lamp 82 illuminates photoconductive belt 20 to remove any residual charge remaining thereon prior to the start of the next successive cycle.

Figure 3:
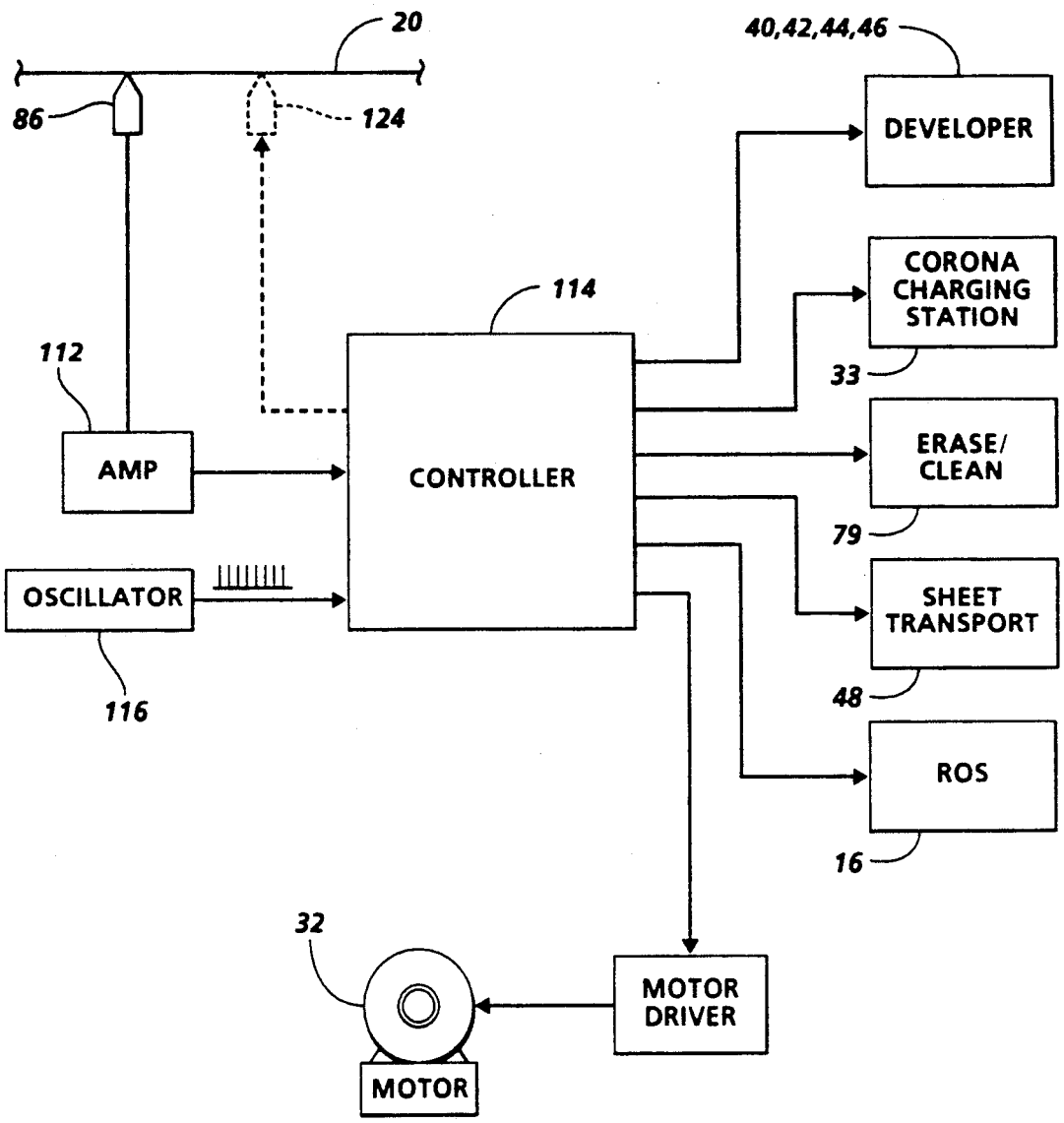
FIG. 3 is a block diagram illustrating the interaction between the present invention and the electromechanical subsystems of the electrophotographic printing machine of FIG. 1.

Referring next to FIG. 3, where a block diagram illustrates the component elements required for the present invention to regulate the electromechanical subsystems of the electrophotographic printing machine of FIG. 1, once again, magnetic pickup 86 is shown as a read head suitable for reading the information contained on the magnetic strip affixed to a surface of belt 20. Once the magnetic signals are read, they would be amplified by by amp 112 before being passed to controller 114. Controller 114 may be an analog or digital logic controller, such as a programmable logic device, or possibly a commonly known microcontroller. As depicted in the figure, controller 114 would receive the amplified signal from the magnetic tape and would compare the frequency of the signal to that of a regular, periodic signal from oscillator 116. The output of the comparison operation being used to generate the control signal sent to motor driver 120, which ultimately would control the speed of drive motor 32. Alternatively, controller 114 could determine the deviation of the amplified magnetic signal from a nominal frequency. For example, this could be accomplished by a phase-locked loop semiconductor device, for example, the LM565 Series of Phase Locked Loops from National Semiconductor. Such a device would typically employ an internal oscillator circuit. As yet another alternative, a commonly known frequency-to-voltage converter circuit combined with a comparator, for example, the National Semiconductor LM2907 or LM2917, may be used to generate the control signal.

Figure 4:
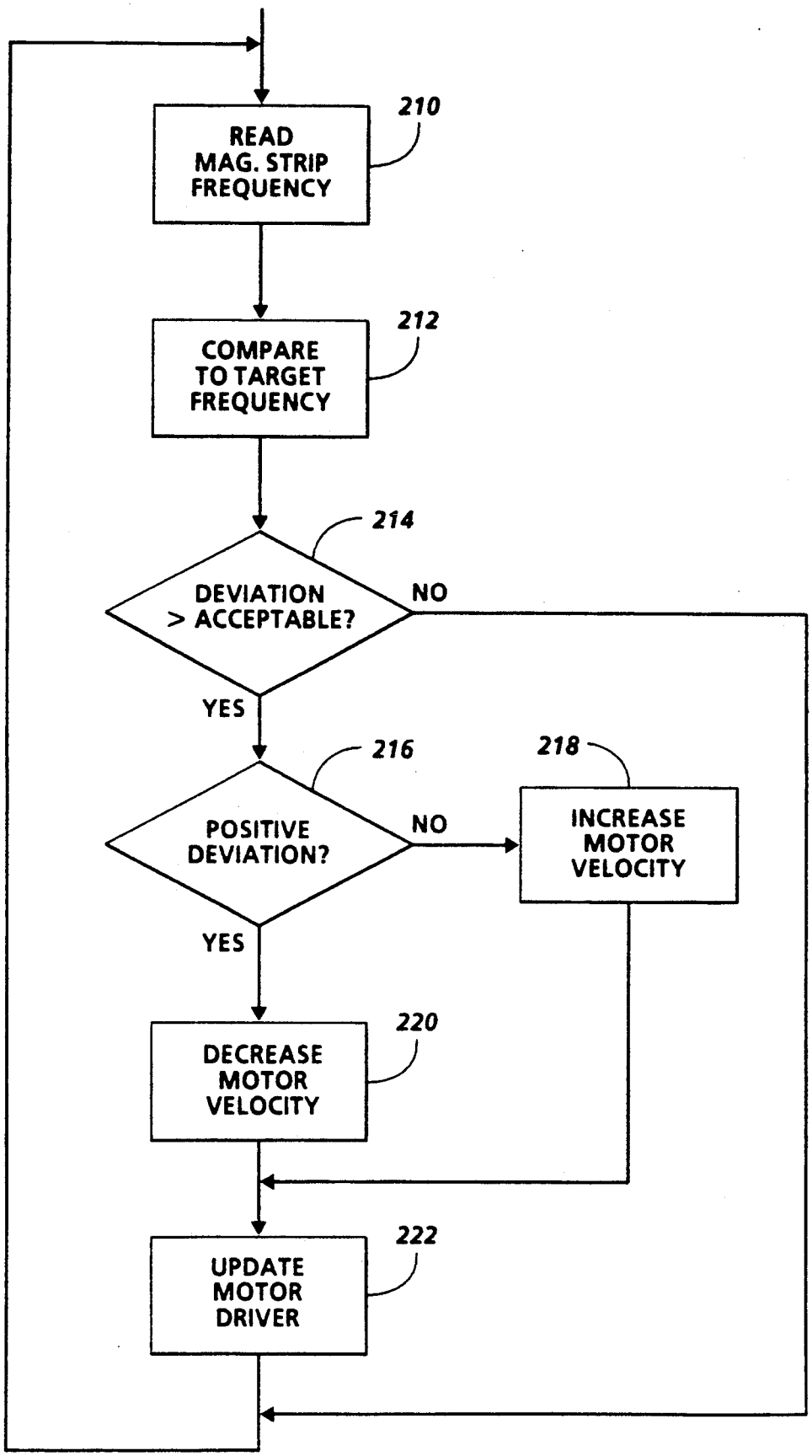
FIG. 4 is a flowchart which generally depicts the processing steps carried on by the controller of FIG. 3.
Figure 5A:
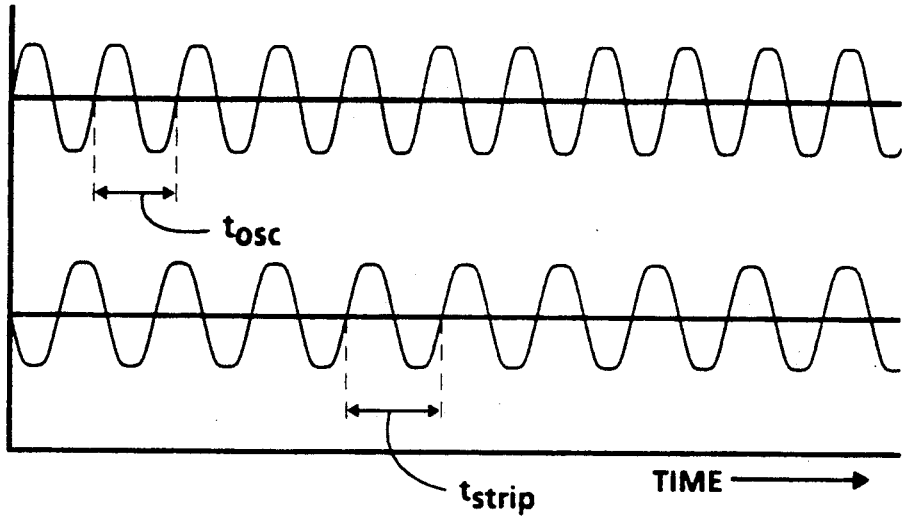
FIGS. 5A and 5B illustrate typical waveforms of signals recorded on a magnetic strip in one embodiment of the present invention.
Figure 5B:
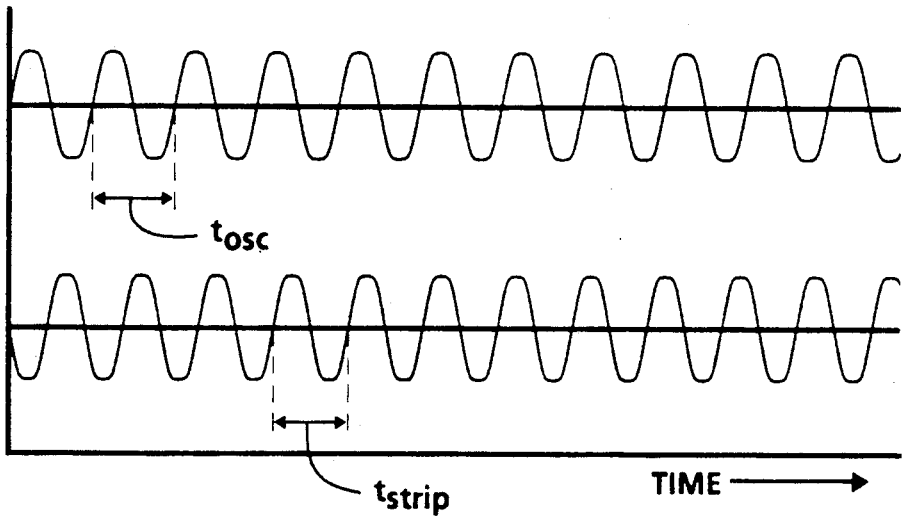

As illustrated in FIG. 4, and by the waveshapes of FIGS. 5A and 5B, the control process executed by controller 114 could be a continuous looping-type feedback process. The process begins at step 210, where the instantaneous frequency of magnetic signals recorded on the magnetic strip is read. The magnetic strip contains, along one track thereon, a periodic base signal, where the signal is prerecorded on the magnetic tape. Typically the base signal period would be constant over the entire length of the strip. However, it is conceivable that the belt may be moved at various speeds during the printing process, which may be controlled by varying the period of the signal on the magnetic strip. The frequency of the magnetic strip is determined by sensing the period of the most recent signal cycle. For example, time $t_{strip}$, of FIG. 5A is determined based upon the zero-crossing points of the increasing signal, although any similar means of isolating or averaging the period of the signal may be used.

Once the frequency of the signal on the magnetic strip is determined ($1/t_{strip}$), the frequency of the oscillator ($1/t_{osc.}$) is determined in a similar fashion by controller 114, step 212. Next, the difference between the two frequencies, or the deviation, would be compared to determine if the deviation is within an acceptable range, step 214. The upper and lower thresholds which define the acceptable deviation range are a function of the nominal belt speed, the oscillator frequency, and the resolution of the printing system. If the deviation is outside of the acceptable range, the speed of the belt must be adjusted. Otherwise, no adjustment is needed and the control loop returns to step 210 to once again sample the belt signal frequency.

When, as illustrated in FIG. 5B, the magnetic strip signal frequency is greater than the oscillator frequency, when time $t_{osc.}$ is greater than time $t_{strip}$, as determined by step 216, the velocity of the motor must be decreased, step 218. Conversely, as illustrated in FIG. 5A, when the magnetic strip signal frequency is less than the oscillator frequency, for time $t_{osc.}$ less than time $t_{strip}$, as determined by an affirmative response at step 216, the velocity of the motor must be increased, step 220. The amount by which the motor velocity is varied on any given pass through the steps of the control loop would be a function of the amount of deviation from the nominal operating speed of the belt. Subsequently, the new motor speed is sent to the motor driver 120 of FIG. 3, step 222, and the speed control loop returns to step 210 to restart the control process.

Referring once again to FIG. 3, magnetic pickup 86 may also be a multi-head device suitable for concurrently reading signals from additional tracks of the magnetic strip on belt 20. Magnetic signals on the other tracks may be used to regulate the elements of the printing engine in timed relation with the movement of photoconductive belt 20. The additional tracks of magnetic signals from magnetic strip 88 could be used, for example, as simple timing signals which control the operation of; developers 40, 42, 44, and 46, charging station 33, cleaning station 79, sheet transport 48 or ROS 16, as previously described with respect to FIG. 1. Alternatively, the additional tracks of magnetic signals may be used to specifically identify unusable regions on photoconductive belt 20, including any seams or damaged areas thereon. In general, by utilizing a specific signal waveshape to identify the regions of interest, and including the capability to decode the signal waveshapes in controller 114, the unusable regions of belt 20 could be identified and tracked as they travel along the path of the belt. As an enhancement to this embodiment, FIG. 3 also includes an optional magnetic write head, 124. The purpose of the write head is to enable the recording of information on the magnetic strip subsequent to installation into marking engine 18. Using write head 124, a service technician could operate the marking engine in a diagnostic mode and record the coded identifying signals on an unused track of the magnetic strip, which, when later read by magnetic pickup 86, would be used to identify those regions on the imaging surface of belt 20 which were not suitable for imaging. Similarly, the additional tracks could be used in a multiple pitch printing engine, one having the capacity for exposure of two or more image regions on the photoreceptor, to identify the imaging panels. Also the independent tracks may each contain different base frequency signals such that the selection of a specific track to provide the base or drive frequency signal thereby selects the speed at which the photoconductive belt will run, as may be desirable, for example, when switching a multicolor printing engine between a low-speed color mode and a higher-speed black-only mode.

The aforedescribed motion control system, while described in connection with a photoreceptor belt, may be extended to control the motion of similar belts or rigid members. For example, sheet transport belts used in document handlers may employ the present invention to control the motion thereof.

In recapitulation, the present invention is a method and apparatus for controlling the motion of a rotating or advancing member. The motion of the member may be controlled with respect to a predetermined velocity, and the movement of the member itself may be used to control the operation of other operative mechanisms associated with the member. Hence, the velocity of the member is accurately determined without any velocity sensing error being introduced as a result of mechanical slack between the member and the sensing device, or slippage and expansion of the member itself.

It is, therefore, apparent that there has been provided, in accordance with the present invention, a method and apparatus for controlling the velocity of a photoconductive belt in a printing engine. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for regulating the velocity of a belt moving in a recirculating path, comprising:

a magnetic strip, located on a surface of the belt, having a plurality of magnetic signals recorded thereon, wherein the magnetic signals are prerecorded on said magnetic strip in a predetermined varying fashion;

a magnetic detector, positioned in proximity to said magnetic strip, for sensing the magnetic signals recorded thereon, during movement of the belt, and producing an output signal in response to the magnetic signals;

means for driving the belt; and control means, responsive to the output signal, for regulating said driving means so as to produce a varying frequency output signal when the belt is driven at a constant velocity.

2. A printing machine for producing copies of an original document, comprising:

a movable charge retentive member;

a magnetic recording strip on a surface of said charge retentive member, said magnetic recording strip having a plurality of magnetic signals recorded thereon;

processing means for generating and developing a latent image on said charge retentive member and transferring the developed image from said charge retentive member to a copy sheet;

means for controlling the operation of said processing means in response to the signals recorded on said magnetic recording strip; and means, responsive to the signals recorded on the magnetic recording strip, for regulating the velocity of said charge retentive member.

3. The printing machine of claim 2, wherein said velocity regulating means includes:

a magnetic detector, positioned in proximity to the magnetic recording strip, for sensing signals recorded thereon, during movement of said charge retentive member, and producing an output signal in response to the recorded signals;

means for driving said charge retentive member; and a velocity controller, responsive to the output signal, for regulating said driving means.

4. The printing machine of claim 3, wherein the output signal produced by said magnetic detector includes a base frequency signal.

5. The printing machine of claim 4, wherein said velocity controller comprises:

comparing means, responsive to the base frequency signal, for determining a difference signal as a function of a frequency differential between the base frequency signal and a predetermined frequency; and velocity adjusting means, responsive to the difference signal, for adjusting the velocity of said driving means.

6. The printing machine of claim 5, further comprising an oscillator for producing a signal at the predetermined frequency.

7. The printing machine of claim 3, wherein said magnetic detector produces a composite output signal including a base frequency signal and a secondary signal, and wherein the apparatus further comprises sensing means, responsive to the secondary signal, for identifying a location on the charge retentive member by the presence of the secondary signal at a corresponding location on said magnetic recording strip.

8. The printing machine of claim 7, wherein said sensing means comprises:

signal discriminating means, connected to said magnetic detector, for recognizing that the magnetic signals indicate a location on the belt; and means for decoding the magnetic signals recognized by said signal discriminating means, and thereby determining the identity of the location from the decoded signals.

9. The printing machine of claim 3, wherein the magnetic signals are prerecorded on the magnetic strip in a periodic fashion so as to cause said magnetic detector to produce a constant frequency output signal when the charge retentive member is driven at a constant velocity.

10. The printing machine of claim 3, wherein the magnetic signals are prerecorded on the magnetic strip in a predetermined varying fashion so as to cause said magnetic detector to produce a varying frequency output signal when the charge retentive member is driven at a constant velocity.

11. The printing machine of claim 2, wherein said controlling means comprises:

magnetic detector means, operatively associated with said magnetic recording strip, so as to sense signals recorded thereon during movement of said charge retentive member, and to produce a composite output signal in response to the sensed signals; and logic means for producing control signals in response to the composite output signal, the control signals being used to regulate said processing.

12. The printing machine of claim 11, wherein said logic means comprises a microcontroller including:

a plurality of input/output lines for receiving the output signal and transmitting the control signals; and a memory resident executable control program to monitor the output signal from said magnetic detector means and generate the control signals in response to the output signal.

13. The printing machine of claim 2, further comprising means for transporting the copy sheet to a position adjacent said charge retentive member to facilitate transfer of the developed image, said controlling means regulating said transporting means.

14. The printing machine of claim 2, wherein said processing means further comprises means for cleaning the surface of said charge retentive member, said cleaning means being regulated by said controlling means.

15. The printing machine of claim 2, wherein:

the magnetic recording strip has at least two parallel tracks of prerecorded signals thereon;

said magnetic detector produces a first output signal in response to the magnetic signals recorded on a first track and a second output signal in response to the magnetic signals recorded on a second track;

said controlling means controls the operation of said processing means in response to the first output signal; and said regulating means regulates the velocity of said charge retentive member in response to the second output signal.

16. An apparatus for regulating the velocity of a belt moving in a recirculating path, comprising:

a magnetic strip, located on a surface of the belt, having a plurality of magnetic signals recorded thereon, wherein the magnetic signals have a varying signal period;

a magnetic detector, positioned in proximity to said magnetic strip, for sensing the magnetic signals recorded thereon, during movement of the belt, and producing an output signal in response to the magnetic signals;

means for driving the belt; and control means, responsive to the output signal, for regulating said driving means so that the belt is driven at a varying velocity which is a function of the output signal.

* * * * *